United States Patent [19]

Shankel et al.

[11] 3,989,242

[45] Nov. 2, 1976

[54] GAME OF MANUAL DEXTERITY

[75] Inventors: John Shankel; Marilou Shankel, both of San Francisco, Calif.

[73] Assignee: Lawrence Peska Associates, Inc., New York, N.Y. ; a part interest

[22] Filed: Apr. 3, 1975

[21] Appl. No.: 564,599

[52] U.S. Cl. ..... 273/1 R; 35/22 R

[51] Int. Cl.[2] ..... A63F 9/00

[58] Field of Search ..... 273/1 R, 1 E, 1 M, 85; 35/22 R, 22 A

[56] References Cited

UNITED STATES PATENTS

| | | | |
|---|---|---|---|
| 2,729,020 | 1/1956 | Frampton | 35/22 A X |
| 2,985,451 | 5/1961 | Sims | 273/1 R |
| 3,172,664 | 3/1965 | Lohr et al. | 273/85 R X |
| 3,721,440 | 3/1973 | Burns | 273/1 R |

*Primary Examiner*—Paul E. Shapiro

[57] ABSTRACT

A board game of manual dexterity includes a playing board divided into two identical zones. A large circle is centrally contained within each zone, as well as ten small circles numbered from one to ten, and a medium size start circle. Two differently colored circular disc are moved on the small circles. A pair of cylindrical shaped members held between two fingers of a player are transferred from the large circle of one zone to the large circle of the other zone with a given period of time.

6 Claims, 4 Drawing Figures

FIG. 1
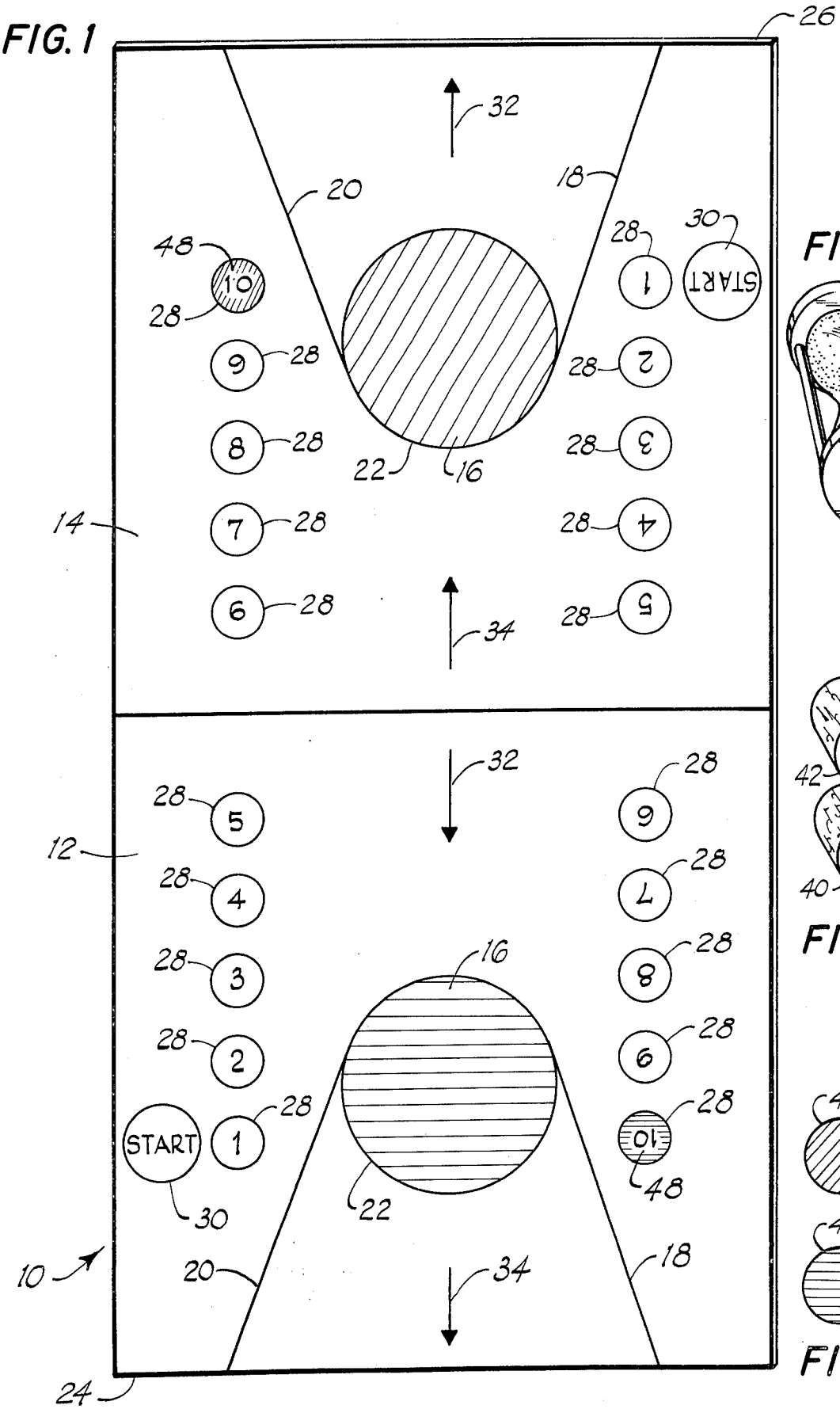
FIG. 4
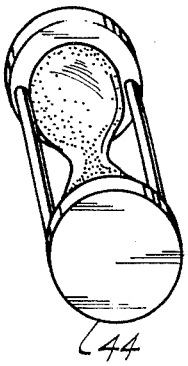
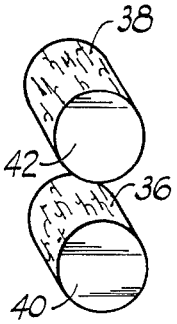
FIG. 3
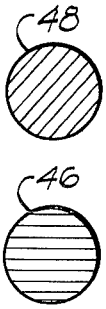
FIG. 2

GAME OF MANUAL DEXTERITY

SUMMARY OF THE INVENTION

My present invention relates to a unique and novel board game of manual dexterity, wherein a player attempts to transfer, while inverting, two cylindrical shaped cork members from one area to another area of a playing board. The cork members are held side by side between two fingers of the player.

A number of U.S. Pat. Nos. 3,479,751; 3,594,002, and 3,710,455 have employed various means of teaching manual dexterity, but these aforementioned patents are non-applicable to my present invention.

An object of my present invention is to provide a board game of manual dexterity serving as a means of entertainment that is universally acceptable to all age groups.

Briefly, my present invention comprises a playing board divided into two identical zones. A large circle is centrally contained within each zone as well as 10 small circles numbered from one to ten, and a medium size start circle. Two differently colored circular disc are moved on the small circles. A pair of cylindrical shaped members held between two fingers of a player are transferred from the large circle of one zone to the large circle of the other zone with a given period of time.

BRIEF DESCRIPTION OF THE DRAWINGS

The objects and features of the invention may be understood with reference to the following detailed description of an illustrative embodiment of the invention, taken together with the accompanying drawings in which:

FIG. 1 illustrates a top planar view of a playing board of a game of manual dexterity;

FIG. 2 illustrates a top view of a pair of colored circular disc members of the game of manual dexterity;

FIG. 3 illustrates a perspective view of a pair of cork members of the game of manual dexterity; and FIG. 4 illustrates a perspective view of a timer unit.

DESCRIPTION OF THE PREFERRED EMBODIMENT

Turning now descriptively to the drawings in which similar reference characters denote similar elements throughout the several views, FIG. 1 shows a rectangular shaped playing board 10 of a game of manual dexterity. The board 10 is divided in half into two identical zones 12, 14. Each zone 12, 14 has a large circle 16 contained centrally therein, wherein guide lines 18, 20 extend tangentially from the outer periphery 22 of each circle to one of the distal ends 24, 26 of the board 10. Ten small circles 28 numbered sequentially from one to ten are contained in each zone 12, 14. A medium size start circle 30 is contained in each zone 12, 14. A pair of arrow shaped indicia 32, 34 oriented in a longitudinal direction are contained in each zone 12, 14 wherein the arrow shaped indicia 32, 34 point towards the distal ends 24, 26. Each large circle 16 is colored a different color such as green and red.

FIG. 2 shows two circular disc members 46, 48 of two different colors such as green and red.

FIG. 3 shows a pair of cylindrical shaped cork members 36, 38, wherein the distal ends 40, 42 of each cork member 36, 38 are coded a different color such as red and green.

FIG. 4 shows a hour glass type timer 44 for a period of one minute. Other suitable timer assemblies such as a stop watch or clock can be readily employed.

The game is played as follows:

Two players participate in the game, wherein each player is assigned a zone 12, 14. One player places one of the disc members in a concealed position in one of his hands. The second player attempts to guess whether the disc is green or red. If the second player guesses correctly, he has the option of playing first or second. A player places the two cork members 36, 38 in the large circle 16 of his zone 12. The same colored distal ends 40 of each cork member 36, 38 face upwardly. Each player places one of the disc members 46, 48 in the start circle 30 of their zones 12, 14. The first player attempts to transfer simultaneously the two cork members 36, 38 from the circle 16 of his zone 12 to the large circle 16 of his opponent's zone 14. The cork member 36, 38 must be inverted as they are transferred such that their other distal ends 42 face upwardly. After the transfer has been completed within a time period of one minute as measured on the timer 44, the player advance his disc member 46 from the start circle 30 to the small circle numbered one. A player holds the play as long as he continues to effect a legal transfer of cork members 36, 38. The first player to effect ten legal transfers is declared the winner. The player moves his disc member 36 to the next higher numbered circle 28 upon the completion of each legal transfer. The player picks up the two cork members 36, 38 between any two fingers of one of his hands, wherein the cork members 36, 38 must be positioned side by side between the two fingers. The two cork members 36, 38 cannot be aligned lengthwise between the fingers. The thumb may not be employed in picking up the two cork members 36, 38. The wrist and arm of the player cannot extend inwardly past the distal end 24 into the zone 12. The hand of the player must stay within the area of the zone 12 as defined by the large circle 16 and guide lines 18, 20.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what we claim as new and desire to secure by Letters Patent of the United States is:

1. A game of manual dexterity, which comprises:

a. a playing board having two identical zones and a pair of distal ends;

b. a large circle having an outer periphery contained centrally in each said zone;

c. ten small circles numbered sequentially from one to ten contained in each said zone;

d. one medium size start circle contained in each said zone;

e. a pair of cylindrical shaped members having a pair of distal ends adapted to be held between two fingers of a player, said cylindrical shaped members transferred from one said large circle of one said zone to the other said large circle of the other said zone;

f. a timer unit; and g. a pair of circular disc members, one said circular disc member moved from said start circle through said small circles of each said zone.

2. A game as recited in claim 1, wherein said timer unit is an hour glass type timer.

3. A game as recited in claim 2, wherein said hour glass type timer measures one minute.

4. A game as recited in claim 3, wherein the large circle of each said zone being of a different color, the only said circular disc members being of said different colors, and each said cylindrically shaped member having one of said distal ends of one color and said other end being of a second color.

5. A game as recited in claim 4, wherein each said zone further includes a pair of guide lines extending tangentially from the outer periphery of the rear large circle to each said distal end of said playing board.

6. A game as recited in claim 5, wherein each said cylindrical shaped member is a cork.

* * * * *